US012168850B2

(12) United States Patent
Boeck

(10) Patent No.: US 12,168,850 B2
(45) Date of Patent: Dec. 17, 2024

(54) FABRIC TAPE

(71) Applicant: Volth Patent GmbH, Heidenheim (DE)

(72) Inventor: Johann Boeck, Fornach (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 18/217,562

(22) Filed: Jul. 1, 2023

(65) Prior Publication Data

US 2024/0018717 A1 Jan. 18, 2024

(30) Foreign Application Priority Data

Jul. 12, 2022 (DE) ..... 102022117300.3

(51) Int. Cl.

| | |
|---|---|
| ***D21F 7/08*** | (2006.01) |
| ***D03D 3/04*** | (2006.01) |
| ***D21F 1/00*** | (2006.01) |
| *D03D 11/00* | (2006.01) |

(52) U.S. Cl.

CPC ..... *D21F 1/0036* (2013.01); *D03D 3/04* (2013.01)

(58) Field of Classification Search

CPC ..... D21F 1/0036; D21F 7/083; D21F 1/105; D03D 3/04; D03D 11/00; D03D 1/0094; D03D 13/004

See application file for complete search history.

(56) References Cited

U.S. PATENT DOCUMENTS

| | | | | |
|---|---|---|---|---|
| 4,749,007 | A * | 6/1988 | Malmendier | D21F 1/0036 139/411 |
| 6,827,821 | B2 * | 12/2004 | Brewster | D21F 1/0036 162/902 |
| 2004/0104005 | A1 * | 6/2004 | Brewster | D21F 7/083 162/358.2 |

FOREIGN PATENT DOCUMENTS

| | | | |
|---|---|---|---|
| DE | 102012207044 | A1 | 10/2013 |
| WO | WO2013160391 | A1 | 10/2013 |

* cited by examiner

*Primary Examiner* — Robert H Muromoto, Jr.
(74) *Attorney, Agent, or Firm* — Von Rohrscheidt Patents

(57) ABSTRACT

A forming fabric tape for a machine for producing and/or processing a fiber material web, the forming fabric tape including an upper fabric layer including upper longitudinal threads and upper transversal threads woven into the upper longitudinal threads; and a lower fabric layer including lower longitudinal threads and lower transversal threads woven into the lower longitudinal threads, wherein the upper fabric layer and the lower fabric layer are arranged on top of one another so that the upper fabric layer is oriented towards the fiber material web being produced when the fabric tape is being used in the machine and the lower fabric layer is oriented away from the fiber material web being produced, wherein a first distance A1 between two directly adjacent lower longitudinal threads is greater than a second distance A2 between two directly adjacent lower longitudinal threads.

16 Claims, 2 Drawing Sheets

FABRIC TAPE

RELATED APPLICATIONS

This application claims priority from and incorporates by reference German Patent Application DE 10 2022 117 300.3 filed on Jul. 12, 2022.

FIELD OF THE INVENTION

The invention relates to a fabric tape, in particular a forming fabric for a machine for producing and/or processing a fiber material web.

BACKGROUND OF THE INVENTION

A generic fabric tape is known, for example, from the printed documents WO 2013 160 391 A1 and DE 10 2013 218 465 A1. In both documents the fabric tape includes a different number of upper and lower longitudinal threads wherein a ratio of upper and lower longitudinal threads advantageously is not an integer. The multilayer configuration of the fabric tape has the advantage that the upper longitudinal threads can be configured thinner than the lower longitudinal threads to provide the smoothest surface possible for the fiber material web, whereas the lower longitudinal threads can be primarily configured to absorb tension forces impacting the webbing and resist wear as long as possible. While the fabric tape includes more upper longitudinal threads than lower longitudinal threads in the first printed document the ratio is reversed for the second fabric tape in the second printed document. In both cases, the upper and lower longitudinal threads are combinable into groups which differ from one another with respect to the number of longitudinal threads.

In particular when using the fabric tape as a forming fabric for producing a fiber material web, it is not desirable that fabric tape cause clearly visible markings in the fiber material web to be produced. Markings are created when water is removed from the fiber material web unevenly. Since the water has to flow around the longitudinal threads and the transversal threads the weaving pattern influences marking properties of the fiber material web. The so-called hydraulic markings are caused substantially by the lower longitudinal threads in combination with the lower transversal threads. Therefore, efforts have been made in the past to keep distances between the lower longitudinal threads in the transversal direction in the fabric tape as universal as possible.

However, the generic fabric tape still causes a large amount of markings in the fiber material web which is undesirable.

BRIEF SUMMARY OF THE INVENTION

Thus, it is an object of the invention to solve or mitigate the issues recited supra.

The object is achieved by a forming fabric tape for a machine for producing and/or processing a fiber material web, the forming fabric tape comprising: an upper fabric layer including upper longitudinal threads (O1-O5) and upper transversal threads woven into the upper longitudinal threads; and a lower fabric layer including lower longitudinal threads and lower transversal threads woven into the lower longitudinal threads, wherein the upper fabric layer and the lower fabric layer are arranged on top of one another so that the upper fabric layer is oriented towards the fiber material web being produced when the fabric tape is being used in the machine and the lower fabric layer is oriented away from the fiber material web being produced, wherein a first distance A1 between two directly adjacent lower longitudinal threads U1-U4 is greater than a second distance A2 between two directly adjacent lower longitudinal threads U1-U4, and wherein a difference between the first distance A1 and the second distance A2 is between 20% and 175% of diameter of an upper longitudinal thread, advantageously between 25% and 175%. Additional advantageous features are recited in the dependent claims.

Surprisingly the inventors have found that it is advantageous contrary with respect to the hydraulic properties of the fabric tape when the lower longitudinal threads are not arranged with a uniform distance from each other which is contrary to the prevailing teachings in the art. The inventors explain the discovery by a significant portion of the hydraulic marking properties being caused by uniform hydraulic diagonal markings which are significantly reduced according to the invention by lower longitudinal threads that are arranged at non-uniform distances from each other.

It is appreciated that a distance between two adjacent threads is an average distance in the instant patent application. In particular in SSB (sheet support binding) forming fabrics it can occur that in particular the upper longitudinal threads do not run completely straight in the longitudinal direction of the fabric tape, but run in a wave pattern to the left and to the right, this means towards the lateral edges of the fabric tape. This wave pattern is caused by the binding threads which press the upper longitudinal threads to the right and to the left, depending on which side of the upper longitudinal thread the binding threads come down when they are configured as transversal threads. Therefore, a distance between two upper longitudinal threads viewed in the longitudinal direction of the webbing does not always have to be constant. In view of this fact the instant application uses an average distance of two adjacent longitudinal threads. Put differently, a straight longitudinal thread is presumed that is arranged at a center of the wave line, in case the distance varies in the longitudinal direction of the fabric tape in a form of a wave line. This average distance of the upper longitudinal threads is adjustable during production of the fabric tape. Typically, fabric tapes of this type are woven flat, thermally fixed and subsequently closed on a splicing machine by a spliced seam to form a continuous closed belt. When using a flat weaving method, the longitudinal threads are the weft threads and the transversal threads are the warp threads. The distance of the weft thread is adjustable in the so-called weaving reed.

Like in the generic fabric tapes, all upper longitudinal threads have an identical cross section and an identical diameter which is also preferred according to the instant invention in order to prevent topographic markings in the fiber material web to be produced. The cross section typically is circular. However, should another cross section be chosen, the diameter is the diameter of a corresponding circular cross section that has the same surface area.

Furthermore, the upper longitudinal threads advantageously have a smaller diameter than the lower longitudinal threads, wherein the diameter of an upper longitudinal thread is typically 40% to 75% of a diameter of a lower longitudinal thread. The diameter of the upper longitudinal threads can be, for example, between 0.07 mm and 0.30 mm and the diameter of the lower longitudinal threads can be between 0.15 mm and 0.50 mm.

As described in the documents WO 2013/160391A1 and DE 10 2013 218 465 A1 the weaving pattern of the fabric tape is advantageously repeated in repeat patterns wherein the upper longitudinal threads and the lower longitudinal threads are arranged in several groups in each repeat pattern, including a first group and a second group and at least one additional first group and/or second group wherein each first group is formed from an upper longitudinal thread and a lower longitudinal thread arranged below the upper longitudinal thread, and each second group is respectively formed either from two upper longitudinal threads and a lower longitudinal thread arranged below the two upper longitudinal threads or an upper longitudinal thread and two lower longitudinal threads arranged below the upper longitudinal thread.

Advantageously the fabric tape includes only first and second groups of longitudinal threads. The upper and lower longitudinal threads in each group are offset relative to each other not at all or only by a small amount viewed orthogonal to the fabric layers so that a free space of a half diameter of an upper longitudinal thread at the most is formed laterally protruding between the longitudinal threads with respect to the entire group. The quotient of the number of the upper longitudinal threads divided by the number of the lower longitudinal threads advantageously is not an integer. Additionally, a repeat pattern of the fabric tape can include one or plural repeat units of first and second groups of longitudinal threads, wherein each repeat unit includes a fixed sequence of first and second groups. Advantageously the group repeat sequence is 15 at the most. Fabric tapes which have fewer upper longitudinal threads than lower longitudinal threads may have the subsequent longitudinal thread ratios in respective groups:

| | |
|---|---|
| 3:4 | 1:1-1:2-1:1 |
| 5:7 | 1:2-1:1-1:1-1:2 |
| 7:10 | 1:2-1:2-1:2-1:1-1:1-1:1-1:1 |
| 3:5 | 1:2-1:2-1:1 |
| 5:8 | 1:2-1:2-1:2-1:1-1:1 |
| 4:7 | 1:2-1:2-1:2-1:1 |

A first group of longitudinal threads is noted at 1:1, whereas a second group is noted at 1:2. In fabric tapes that include more upper longitudinal threads than lower longitudinal threads the ratio of the second group would be 2:1 instead of 1:1. In the embodiments recited supra the total ratio of the upper longitudinal threads to the lower longitudinal threads would be inverted, thus 4:3 instead of 3:4.

A first embodiment of the fabric tape according to the invention provides that all second groups are respectively formed from two upper longitudinal thread and a lower longitudinal thread arranged thereunder, wherein the two lower longitudinal threads of two directly adjacent second groups have a first distance from each other and wherein the two lower longitudinal threads of a first group and a second group directly adjacent to the first group have the second distance. When a repeat unit is made from two second groups followed by a first group, the lower longitudinal threads can include a continuously repeating sequence of the first or large distance, the second or small distance and the second or small distance.

A second embodiment of the fabric tape according to the invention provides that all second groups are respectively formed from two upper longitudinal threads and one lower longitudinal thread arranged under the two upper longitudinal threads, wherein the two lower longitudinal threads of two directly adjacent first groups have the second distance from each other, and wherein the two lower longitudinal threads of a first group and a second group directly adjacent to the first group have the first distance from each other. When a repeat unit is made, for example, from a second group followed by two first groups, the lower longitudinal threads can have a continuously repeating sequence of the first or large distance, the second or small distance and the first or large distance.

In the first embodiment and in the second embodiment of the fabric tape according to the invention, also the upper longitudinal threads can have uneven distances from each other. Thus, a minimum distance of upper longitudinal threads can be provided between the two upper longitudinal threads of a second group. A minimum distance or the minimum distance between two directly adjacent upper longitudinal threads is advantageously at least 50% of the diameter of an upper longitudinal thread and/or advantageously corresponds at the most to the sum of the diameter of an upper longitudinal thread and the diameter of a lower longitudinal thread.

A third advantageous embodiment of the fabric tape according to the invention provides that all second groups are respectively formed from an upper longitudinal thread and two lower longitudinal threads arranged below the upper longitudinal thread, wherein the two lower longitudinal threads of a second group have the second distance from each other and wherein the two lower longitudinal threads of a first group and of a second group directly adjacent to the first group and/or the two lower longitudinal threads of two directly adjacent first groups have the first distance from each other. When a repeat unit includes a first group followed by a second group and by an additional first group, the lower longitudinal threads can have a continuously repeating sequence of first or large distance, second or small distance, first or large distance, and first or large distance.

In the third embodiment according to the invention, the upper longitudinal threads can be arranged so that their average distances have the following sequence which is repeated continuously in a transversal direction of the fabric tape: large distance, large distance, small distance, wherein a difference between an average large distance and an average small distance is at least 60%, advantageously at least 120% of a diameter of an upper longitudinal thread. Surprisingly the inventors have determined that hydraulic diagonal marking properties of the fabric tape which are caused by the lower longitudinal threads can be reduced even further by the uneven distances also provided to the upper longitudinal threads. The described uneven distances of the upper longitudinal threads namely yield a very fine topographic marking of the fiber web to be produced which marking extends in a machine direction of the fabric tape and thus interrupts or masks the hydraulic diagonal markings. As a result, the described measures of differential distances of the lower longitudinal threads as well as of the upper longitudinal threads cooperate synergetically which leads to very small hydraulic diagonal marking properties of the fabric tape.

As a matter of principle, however, it is also advantageous not to make the distance differences of the upper longitudinal threads too large so that the induced topographic markings in machine direction of the fabric tape do not become too apparent. The uneven distances between the lower longitudinal threads has a determining impact upon the distances of the upper longitudinal threads. In particular, it can be provided that the difference between a maximum distance of two directly adjacent upper longitudinal threads and a minimum distance of two directly adjacent upper longitudinal threads is 250% at the most, advantageously 200% at the most of a diameter of an upper longitudinal thread.

Advantageously the upper and the lower fabric layer are connected by binding threads arranged in pairs. The binding threads can extend in the transversal direction of the fabric tape. Furthermore, the two binding threads of the respective binding thread pair can be woven together with the upper longitudinal threads and the lower longitudinal threads in an alternating pattern and can cross over in cross over points when alternatively woven with the upper longitudinal threads and the lower longitudinal threads and vice versa.

Furthermore, the upper fabric layer is advantageously formed by weaving the upper longitudinal threads with the upper transversal threads and the binding threads, wherein the lower fabric layer is formed by weaving the lower longitudinal threads with the lower transversal threads, this means that the binding threads are integral components of the upper fabric layer and do not contribute to the lower fabric layer merely connecting the lower fabric layer with the upper fabric layer.

According to an advantageous embodiment of the invention the weaving pattern of the upper fabric layer forms a plain weave. The plain weave is particularly uniform and has the smallest possible repeat unit. Differently from other weaves the plain weave does not have any ridges that extend diagonally. Thus, a plain weave of the upper fabric layer does not cause any increase in the hydraulic diagonal marking that is caused by the lower fabric layer. A diagonal marking is a marking in a diagonal direction of the webbing. The diagonal marking can be caused in particular by diagonally extending ridges.

It is appreciated that fabric tapes that are used as forming fabrics, are typically woven flat, which means that the longitudinal threads correspond to the warp threads and the transversal threads correspond to the weft threads during the production of the fabric tape. The distances of the longitudinal threads from each other can be controlled rather easily by corresponding settings at the warp beam and the weaving reed of the loom. The term "longitudinal thread" designates a thread that extends substantially in the longitudinal direction of the webbing, thus in the direction in which the webbing moves during regular machine operation. Thus, the term "transversal thread" designates a thread which extends substantially in a transversal direction of the webbing thus perpendicular to the longitudinal direction.

BRIEF DESCRIPTION OF THE DRAWINGS

The invention is subsequently described based on advantageous embodiments with reference to drawing figures, wherein.

DETAILED DESCRIPTION OF THE INVENTION

Figure 1:
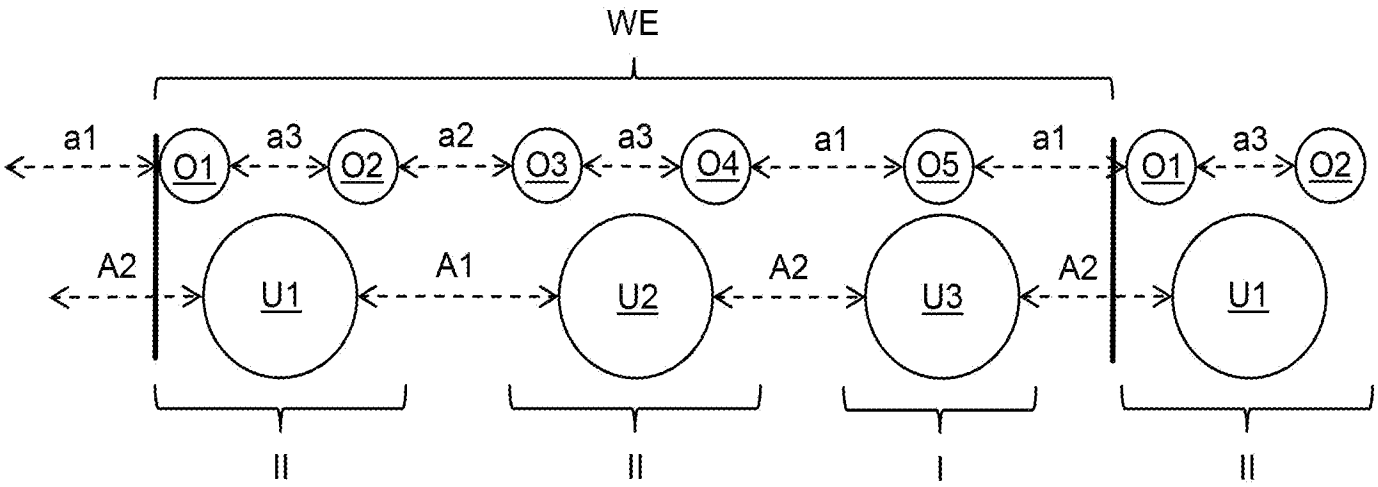
FIG. 1 illustrates a schematic view of a first embodiment of a fabric tape according to the invention.

FIG. 1 schematically illustrates a first embodiment of a fabric tape according to the invention. FIG. 1 only shows the upper longitudinal threads O1-O5 and the lower longitudinal threads U1-U3 which form a repeat unit WE in combination, but does not show other longitudinal threads which are woven together with the upper longitudinal threads O1-O5 to form an upper fabric layer and lower transversal threads which are woven together with the lower longitudinal threads U1-U3 to form a lower fabric layer and binding threads which connect the upper fabric layer with the lower fabric layer. The binding threads are advantageously configured as an integral part of the weaving pattern, in particular of a plain weave of the upper fabric layer, whereas they do no contribute to the weaving pattern of the lower fabric layer.

The fabric tape is assembled by a concatenation of pattern repeats in the longitudinal direction and the transversal direction. With respect to the upper longitudinal threads O1-O5 and the lower longitudinal threads U1-U3 a pattern repeat can include or consist of a single repeat unit WE. Typically, a repeat pattern includes plural repeat units WE. It is appreciated that a pattern repeat is not only defined by the longitudinal threads but also by the transversal threads and the binding threads. When the upper fabric layer is advantageously provided in plain weave a pattern repeat has to include an even number of upper longitudinal threads. Since the repeat unit WE can include or consist of five upper longitudinal threads O1-O5 in the first embodiment according to FIG. 1 the pattern repeat has to include an integer multiple of the repeat units WE, thus at least two repeat units WE.

In the instant first embodiment, a repeat unit WE is formed from three groups of longitudinal threads, namely a second group II including two upper longitudinal threads O1 and O2 and a lower longitudinal thread U1, an additional second group II, including two upper longitudinal threads O3 and O4 and a lower longitudinal thread U2 and a first group I only including an upper longitudinal thread O5 and a lower longitudinal thread U3. Between the first lower longitudinal thread U1 and the second lower longitudinal thread U2 a relatively large distance A1 is provided, whereas a second relatively small distance A2 is provided between the second lower longitudinal thread U2 and the third lower longitudinal thread U3. The same second relatively small distance A2 is arranged between the third lower longitudinal thread U3 and a first lower longitudinal thread U1 of a directly adjacent repeat unit. Thus, a continuously repeating sequence is provided in this embodiment, with respect to the spacing of the lower longitudinal threads in the transversal direction of the fabric tape, wherein the sequence includes the first distance, the second distance and again the second distance.

In this embodiment according to FIG. 1, also the upper longitudinal threads O1-O5 of the repeat unit WE are unevenly spaced from each other. The two upper longitudinal threads O1-O2 and O3-O4 that are respectively associated with a second group II have a relatively small distance a3 from each other. The distance a1 between the lower longitudinal thread O5 that is part of the first group I from a directly adjacent upper longitudinal thread O4 or O1 of a second group II is greater. The distance a2 between the two directly adjacent upper longitudinal threads O2 and O3 of the two second groups II is smaller than the distance a1 but greater than the distance a3.

In this embodiment, all upper longitudinal threads O1-O5 have the same circular cross section and all lower longitudinal threads U1-U3 have the same circular cross section, which however is greater than the circular cross section of the upper longitudinal threads.

The dimensions in this embodiment can be selected as follows:

Diameter of upper longitudinal threads O1-O5: 0.10 mm
Diameter of the lower longitudinal threads U1-U3: 0.21 mm
First distance A1: 0.28 mm
Second distance A2: 0.20 mm
Distance a1: 0.20 mm
Distance a2: 0.15 mm
Distance a3: 0.13 mm This yields an extension of the repeat unit WE of 1.31 mm. The difference between the first distance A1 and the second distance A2 is 0.08 mm which corresponds to 80% of the diameter of the upper longitudinal threads.

It is appreciated that the distances, in particular the distances a1-a3, between the upper longitudinal threads O1-O5 does not have to be constant over an entire longitudinal extension of the fabric tape. These distances can also become narrower and then wider again. Thus, the average distance is relevant as described supra.

Figure 2:
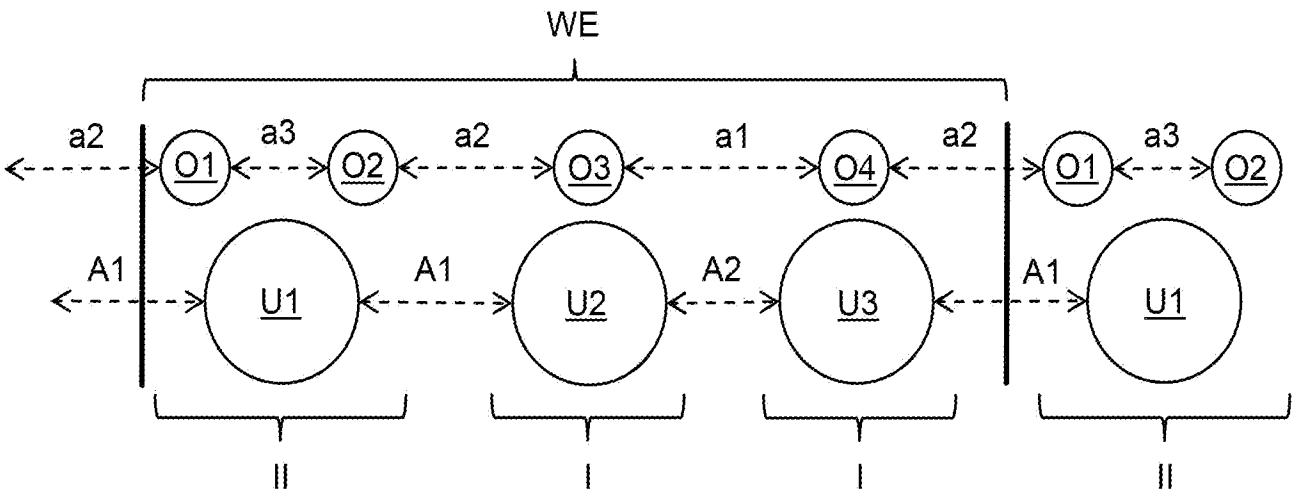
FIG. 2 illustrates a schematic view of a second embodiment of a fabric tape according to the invention.

FIG. 2 schematically illustrates a second embodiment of a fabric tape according to the invention, only showing the upper longitudinal threads O1-O4 and the lower longitudinal threads U1-U3 forming a repeat unit in combination but not showing the upper transversal threads, which are woven together with the upper longitudinal threads O1-O4 to form the upper fabric layer, lower transversal threads which are woven together with the lower longitudinal threads U1-U3 to form a lower fabric layer and binding threads which connect the upper fabric layer with the lower fabric layer. Thus, the binding threads are an integral part of the weaving pattern, in particular of a plain weave of the upper fabric layer, whereas they do not contribute to the weaving pattern of the lower fabric layer.

The instant second embodiment includes a repeat unit WE including three groups of longitudinal threads, namely a second group II including two upper longitudinal threads O1 and O2 and a lower longitudinal thread U1, a first group I including an upper longitudinal thread O3 and a lower longitudinal thread U2, and an additional first group I, including an upper longitudinal thread O4 and a lower longitudinal thread U3. A first relatively large distance A1 is arranged between the first lower longitudinal thread U1 and the second lower longitudinal thread U2, whereas a relatively small distance A2 is arranged between the second lower longitudinal thread U2 and the third lower longitudinal thread U3. The first relatively large distance A1 is also arranged between the third lower longitudinal thread U3 and a first lower longitudinal thread U1 of a directly adjacent repeat unit. This embodiment shows a continuously repeating sequence of first distance, second distance, first distance repeated in the transversal direction of the fabric tape with respect to the spacing of the lower longitudinal threads.

In this embodiment according to FIG. 2 the upper longitudinal threads O1-O4 of the repeat unit WE are spaced unevenly from each other. The two upper longitudinal threads O1-O2 that are part of the second group II have a relatively small distance a3 from each other. The distance a1 between the upper longitudinal thread O3 that is part of the first group and the upper longitudinal thread O4 that is part of the additional first group I is greater. The distance a2 between the upper longitudinal thread O2 of the second group II and a directly adjacent longitudinal thread O3 of the first group I is between the distance a1 and the distance a3.

In this embodiment, all upper longitudinal threads O1-O4 have the same circular cross section and all lower longitudinal threads U1-U3 have the same circular cross section, which however is greater.

The dimensions in this embodiment can be selected as follows:

Diameter of upper longitudinal threads O1-O4: 0.10 mm
Diameter of the lower longitudinal threads U1-U3: 0.21 mm
First distance A1: 0.22 mm
Second distance A2: 0.17 mm
Distance a1: 0.27 mm
Distance a2: 0.22 mm
Distance a3: 0.13 mm This yields a total extension of the repeat unit WE of the 1.24 mm. The difference between the first distance A1 and the second distance A2 is 0.05 mm which corresponds to 50% of the diameter of the upper longitudinal threads.

It is appreciated that the distances, in particular the distances a1-a3, between the upper longitudinal threads O1-O4 do not have to be constant over the entire longitudinal extension of the fabric tape. The distances can also become narrower and wider again. Therefore the average distance is being considered also in this case.

Figure 3:
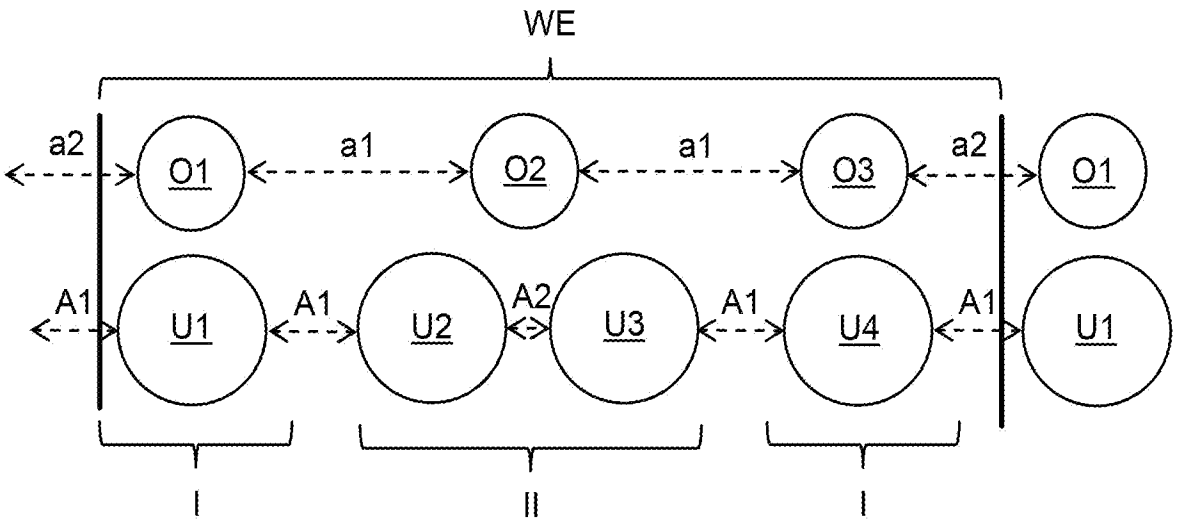
FIG. 3 illustrates a schematic view of a third embodiment of a fabric tape according to the invention.

FIG. 3 schematically illustrates a third embodiment of a fabric tape according to the invention, showing only the upper longitudinal threads O1-O3 and the lower longitudinal thread U1-U4 which form a repeat unit WE in combination but not showing upper transversal threads which are woven together with the upper longitudinal threads O1-O3 forming an upper fabric layer, lower transversal threads which are woven together with the lower longitudinal threads U1-U4 forming a lower fabric layer and binding threads which connect the upper fabric layer with the lower fabric layer. Thus, the binding threads advantageously are an integral part of the weaving pattern, in particular of a plain weave of the upper fabric layer, whereas they do not contribute to the weaving pattern of the lower fabric layer.

The instant third embodiment shows a repeat unit WE including three groups of longitudinal threads, namely a first group I including an upper longitudinal thread O1 and a lower longitudinal thread U1, a second group II including an upper longitudinal thread O2 and two lower longitudinal threads U2 and U3 and an additional second group I including an upper longitudinal thread O3 and a lower longitudinal thread U4. A first relatively large distance A1, is provided between the first lower longitudinal thread U1 and the second lower longitudinal thread U2 and between the third lower longitudinal thread U3 and the fourth lower longitudinal thread U4, whereas a second relatively small distance A2 is provided between the second lower longitudinal thread U2 and the third lower longitudinal thread U3. The first relatively large distance A1 is also arranged between the fourth lower longitudinal thread U4 and a first lower longitudinal thread U1 of a directly adjacent repeat unit. This yields a continuously repeating sequence of first distance, second distance, first distance and first distance in the transversal direction of the fabric tape, in this embodiment with respect to the spacing of the lower longitudinal threads.

In this embodiment according to FIG. 3 also the upper longitudinal threads O1-O3 of the repeat unit WE are unevenly spaced from each other. The upper longitudinal thread O3 has a relatively small distance a2 from the directly adjacent upper longitudinal threads O1 of an adjacent repeat unit. The distance a1 between the upper longitudinal thread O1 that is part of the first group I and the upper longitudinal thread O2 that is part of the second group II is greater. The same distance a1 is also provided between the upper longitudinal thread O2 that is part of the second group II, and the upper longitudinal thread O3, that is part of the additional first group I. This yields the following continuously repeating sequence of the upper longitudinal threads in the transversal direction: large distance, large distance, small distance.

In this embodiment all upper longitudinal threads O1-O3 have the same circular cross section and all lower longitudinal threads U1-U4 have the same circular cross section which, however, is greater.

The dimensions in this embodiment can be selected as follows:

Diameter of upper longitudinal threads O1-O4: 0.14 mm

Diameter of the lower longitudinal threads U1-U3: 0.19 mm

First distance A1: 0.095 mm

First distance A2: 0.049 mm

Distance a1: 0.2645 mm

Distance a2: 0.145 mm

This yields a total extension of the repeat unit WE of the 1.094 mm. The difference between the first distance A1 and the second distance A2 is 0.046 mm which corresponds to 33% of the diameter of the upper longitudinal threads.

It is appreciated that the distances, in particular the distances a1 and a2 between the upper longitudinal threads O1-O3 do not have to the constant over the entire longitudinal extension of the fabric tape. They can also become narrower and wider again. Therefore, the average distance is relevant also in this instance.

What is claimed is:

1. A forming fabric tape for a machine for producing or processing a fiber material web, the forming fabric tape comprising:

an upper fabric layer including upper longitudinal threads and upper transversal threads woven into the upper longitudinal threads; and a lower fabric layer including lower longitudinal threads and lower transversal threads woven into the lower longitudinal threads, wherein the upper fabric layer and the lower fabric layer are arranged on top of one another so that the upper fabric layer is oriented towards the fiber material web and the lower fabric layer is oriented away from the fiber material web, wherein a first distance A1 between two directly adjacent lower longitudinal threads is greater than a second distance A2 between two directly adjacent lower longitudinal threads, and wherein a difference between the first distance A1 and the second distance A2 is between 20% and 175% of a diameter of the upper longitudinal threads.

2. The forming fabric tape according to claim 1, wherein a weaving pattern of the fabric tape is repeated in pattern repeats, wherein the upper longitudinal threads and the lower longitudinal threads are arranged in each pattern repeat in plural groups, including a first group I, a second group II and at least one additional first or second group I, II, wherein each first group I is respectively formed from an upper longitudinal thread and a lower longitudinal thread arranged below the upper longitudinal thread and each second group II is respectively formed either from two upper longitudinal threads and a lower longitudinal thread arranged below the two upper longitudinal threads or an upper longitudinal thread and two lower longitudinal threads arranged below the upper longitudinal thread.

3. The forming fabric tape according to claim 2, wherein all second groups II are respectively formed from two upper longitudinal threads and a lower longitudinal thread arranged below the two upper longitudinal threads, and wherein two lower longitudinal threads of two directly adjacent second groups II have the first distance A1 from each other and two lower longitudinal threads of a first group I and a second group II directly adjacent to the first group I have the second distance A2 from each other.

4. The forming fabric tape according to claim 2, wherein all second groups II are respectively formed from two upper longitudinal threads and a lower longitudinal thread arranged below the two upper longitudinal threads, wherein two lower longitudinal threads of two directly adjacent first groups I have the second distance A2 from each other, and wherein two lower longitudinal threads of a first group I and a second group II directly adjacent to the first group I have the first distance A1 from each other.

5. The forming fabric tape according to claim 3, wherein a minimum distance a3 of the upper longitudinal threads is provided between the two upper longitudinal threads of a second group II.

6. The forming fabric tape according to claim 3, wherein a minimum distance a3 between two directly adjacent upper longitudinal threads is at least 50% of a diameter of an upper longitudinal thread or corresponds to a sum of the diameter of the upper longitudinal thread and the diameter of the lower longitudinal thread at the most.

7. The forming fabric tape according to claim 2, wherein all second groups II are respectively formed from an upper longitudinal thread and two lower longitudinal threads arranged below the upper longitudinal thread, wherein the two lower longitudinal threads of a second group II have the second distance A2 from each other, and wherein the two lower longitudinal threads of a first group I and a second group II directly adjacent to the first group I have the first distance A1 from each other.

8. The forming fabric tape according to claim 7, wherein the upper longitudinal threads are arranged so that their average distances have the subsequent sequence repeated in the transversal direction of the fabric tape: large distance a1, large distance a1, small distance a2, wherein a difference between an average large distance a1 and an average small distance a2 is at least 60% or at least 120% of a diameter of an upper longitudinal thread.

9. The forming fabric tape according to claim 1, wherein a difference between a maximum distance a1 of two directly adjacent upper longitudinal threads and a minimum distance a1, a2 of two directly adjacent longitudinal threads is 200% at the most or 150% at the most of a diameter of an upper longitudinal thread O1-O5.

10. The forming fabric tape according to claim 2, wherein the upper fabric layer and the lower fabric layer are connected with each other by binding threads arranged in pairs.

11. The forming fabric tape according to claim 10, wherein the binding threads run in the transversal direction of the fabric tape.

12. The forming fabric tape according to claim 10, wherein two binding threads of respective binding thread pair are woven with the upper longitudinal threads and the lower longitudinal threads in an alternating pattern and intersect when woven in the alternating pattern with the upper longitudinal threads and the lower longitudinal threads and vice versa forming intersection points.

13. The forming fabric tape according to claim 12, wherein each binding thread pair includes at least two intersection points in the pattern repeat.

14. The forming fabric tape according to claim 10, wherein the upper fabric layer is formed by weaving the upper longitudinal threads with the upper transversal threads and the binding threads and the lower fabric layer is formed by weaving the lower longitudinal threads with the lower transversal threads.

15. The forming fabric tape according to claim 1, wherein the upper fabric layer is provided in plain weave.

16. The forming fabric tape according to claim 2, wherein all second groups II are respectively formed from an upper longitudinal thread and two lower longitudinal threads arranged below the upper longitudinal thread, wherein the two lower longitudinal threads of a second group II have the second distance A2 from each other, and wherein the two lower longitudinal threads of two directly adjacent first groups I have the first distance A1 from each other.

* * * * *